US006655299B2

(12) United States Patent
Preisler et al.

(10) Patent No.: US 6,655,299 B2
(45) Date of Patent: Dec. 2, 2003

(54) REINFORCED COMPOSITE PALLET ASSEMBLY OF THE CELLULAR CORE SANDWICH-TYPE

(75) Inventors: Darius J. Preisler, Fraser, MI (US); David A. Peash, Bloomfield Hills, MI (US)

(73) Assignee: Patent Holding Company, Fraser, MI (US)

( * ) Notice: Subject to any disclaimer, the term of this patent is extended or adjusted under 35 U.S.C. 154(b) by 63 days.

(21) Appl. No.: 10/016,081

(22) Filed: Oct. 30, 2001

(65) Prior Publication Data

US 2003/0079657 A1 May 1, 2003

(51) Int. Cl.[7] ..... B65D 19/00
(52) U.S. Cl. ..... 108/51.3
(58) Field of Search ..... 108/51.3, 57.25, 108/57.27, 901, 902, 57.34, 51.11

(56) References Cited

U.S. PATENT DOCUMENTS

| | | | | |
|---|---|---|---|---|
| 3,470,832 | A | * | 10/1969 | Heffernan |
| 4,937,125 | A | | 6/1990 | Sanmartin et al. |
| 5,205,221 | A | * | 4/1993 | Melin et al. |
| 5,337,681 | A | | 8/1994 | Schrage |
| 5,365,859 | A | | 11/1994 | Schrage |
| 5,465,672 | A | * | 11/1995 | Boyse et al. |
| 5,493,962 | A | * | 2/1996 | McCarthy |
| 5,497,709 | A | | 3/1996 | Gonzalez et al. |
| 5,596,933 | A | | 1/1997 | Knight et al. |
| 5,672,412 | A | * | 9/1997 | Phares et al. |
| 5,673,630 | A | | 10/1997 | Schutz |
| 5,683,782 | A | | 11/1997 | Duchene |
| 5,687,652 | A | | 11/1997 | Ruma |
| 5,720,229 | A | | 2/1998 | Schrage |
| 5,755,162 | A | | 5/1998 | Knight et al. |
| 5,791,262 | A | | 8/1998 | Knight et al. |
| 5,806,436 | A | | 9/1998 | Weichenrieder |
| 5,865,315 | A | | 2/1999 | Uitz |
| 5,868,080 | A | * | 2/1999 | Wyler et al. |
| 5,888,610 | A | | 3/1999 | Fournier et al. |
| 5,891,560 | A | | 4/1999 | Edwards et al. |
| 5,921,189 | A | | 7/1999 | Estepp |
| 5,937,767 | A | | 8/1999 | Togawa et al. |
| 5,950,546 | A | | 9/1999 | Brown et al. |
| 6,006,677 | A | | 12/1999 | Apps et al. |
| 6,050,630 | A | | 4/2000 | Hochet |
| 6,125,770 | A | | 10/2000 | Brandenburg |
| 6,155,181 | A | | 12/2000 | Chilcutt |
| 6,165,604 | A | | 12/2000 | Edwards et al. |
| 6,173,657 | B1 | | 1/2001 | Espejo |
| 6,180,203 | B1 | | 1/2001 | Unkles |
| 6,187,411 | B1 | | 2/2001 | Palmer |
| 6,199,488 | B1 | | 3/2001 | Favaron et al. |
| 6,216,608 | B1 | | 4/2001 | Woods et al. |
| 6,250,234 | B1 | * | 6/2001 | Apps |

FOREIGN PATENT DOCUMENTS

| | | | |
|---|---|---|---|
| EP | 0 473 422 A1 | | 3/1992 |
| EP | 0 551 776 A1 | | 7/1993 |
| EP | 0 649 736 A1 | | 4/1995 |
| EP | 0 783 959 A2 | | 7/1997 |
| FR | 79 23257 | | 4/1980 |
| FR | 5711573 | | 5/1995 |
| JP | 6-239346 | * | 8/1994 |
| WO | WO 88/03086 | | 5/1988 |

* cited by examiner

*Primary Examiner*—Jose V. Chen
(74) *Attorney, Agent, or Firm*—Brooks Kushman P.C.

(57) ABSTRACT

The invention relates to reinforced composite pallet assemblies of the sandwich-type having a cellular core. In a method for making a deck of the assembly, a stack is formed that is made up of: a load-bearing skin made of a reinforced thermoplastics material; an upper grid of reinforcing slats each of which is made of a reinforced thermoplastic composite or pultrusion; a cellular core made of a thermoplastic material; a lower grid of reinforcing slats each of which is also made of a reinforced thermoplastic composite or pultrusion; and a tine-engaging skin made of a reinforced thermoplastic material. Each of the grids of reinforcing slats has a surface area that is smaller than the surface area of each of the skins. The grids of reinforcing slats are positioned symmetrically about a plane formed by the cellular core against the skins. After the stack is processed to form the deck, a plurality of supports or spacers are affixed to the tine-supporting skin such as by an in-mold process. Two such decks interconnected by supports may be used to make a pallet assembly which is stackable and rackable.

18 Claims, 1 Drawing Sheet

REINFORCED COMPOSITE PALLET ASSEMBLY OF THE CELLULAR CORE SANDWICH-TYPE

CROSS-REFERENCE TO RELATED APPLICATION

This application is related to U.S. application Ser. No. 09/485,142, filed Mar. 1, 2000, now issued as U.S. Pat. No. 6,537,413 entitled "A Method of Making a Reinforced Composite Panel of the Cellular-Core Sandwich Type, and a Panel Obtained By Performing Such a Method." This application discloses a method of making locally-reinforced composite panels of the cellular core sandwich-type using reinforcing plies of thermoplastic material.

BACKGROUND OF THE INVENTION

1. Field of the Invention

The present invention relates generally to pallet assemblies of sandwich-type composite structure having a cellular core and, in particular, to such pallet assemblies whose structure is reinforced locally.

2. Background Art

Sandwich-type materials having cellular cores have very important characteristics resulting from their being light in weight yet very rigid.

Conventionally, such a panel is constructed by sandwiching a cellular core having low strength characteristics by gluing it or bonding it between two skins, each of which is much thinner than the cellular core but has excellent mechanical characteristics.

The patent document FR 2 711 573 discloses a method of making a panel of sandwich-type composite structure having a cellular core. In that method, said panel is made in a single step by subjecting a stack to cold-pressing in a mold, which stack is made up of at least a first skin made of a stampable reinforced thermoplastics material, of a cellular core made of a thermoplastics material, of a second skin made of a stampable reinforced thermoplastics material, and of a first external covering layer made of a woven or non-woven material, the skins being preheated outside the mold to a softening temperature.

Such a method is particularly advantageous because of the fact that it makes it possible, in a single operation, both to generate cohesion between the various layers of the composite structure, and to shape the panel.

The resulting panel conserves all of the mechanical properties imparted by the cellular core sandwich structure.

European patent EP 0 649 736 B1 explains the principle of molding substantially flat parts out of thermoplastic sandwich material (TSM). The part is made in a single stage by pressing in a cold mold, at a pressure in the range of 10 bars to 30 bars, a stack consisting of at least a first top skin layer of stampable reinforced thermoplastics material, a cellular or honeycomb core of thermoplastics material and a second bottom skin layer of stampable reinforced thermoplastics material. The axes of the cells of the cellular core are generally oriented perpendicular to the skin layers. The skin layers and core are previously heated outside the mold to a softening temperature. Such sandwich material is also described in U.S. Pat. No. 5,683,782. The cellular core of such material enables the part to be very rigid while being light in weight.

U.S. Pat. No. 6,050,630 discloses a molded composite stack including a cellular core for a vehicle and a mold for forming the stack into a vehicular part, such as a floor panel.

Panels of sandwich-type composite structures having a cellular core have strength characteristics sufficient to enable mechanical structures subjected to large stresses to be reinforced structurally without making them too heavy. Such panels are in common use in shipbuilding, aircraft construction, and rail vehicle construction.

However, the non-uniformness of the mechanical stresses to which they are subjected sometimes makes it necessary to form local reinforcing plies at those places in said panels where the mechanical stresses are greatest.

In the field of aircraft construction, sandwich structure composite panels are made that are based on thermosettable resins reinforced with glass fibers.

In order to impart the desired shapes to the panels, and to maintain the shapes, the glass fibers and the thermosettable resin (in the form of pre-pregnates) are deposited layer-by-layer in a mold, and are then heated to high temperatures so as to cure (i.e. polymerize) the resin permanently.

The molds used may have a punch or a die, or else both a punch and a die.

Making such locally-reinforced panels consists firstly in defining zones where stresses are concentrated in the resulting panels, such zones being defined either by real testing or by computer simulation, and then in adding reinforcing plies at those places so as to make it possible to withstand such stresses.

The reinforcing plies are one-directional mats or woven fabrics of glass fibers, of carbon fibers, or of natural fibers embedded in a thermosettable resin, with an orientation that is determined by the orientation of the stresses. They are cut out to a pattern using special machines, e.g. water-jet cutting machines.

The reinforcing plies are disposed layer-by-layer in a mold, either manually or by means of a robot, with each ply having its own orientation.

That operation may be referred to as the "laying up" operation.

Then comes the baking step which is the longest step of the method of making such pieces because the stack of layers must be heated sufficiently to cure the thermosettable resin.

The various layers disposed in the mold are pressed in the mold by evacuating the mold. Such evacuation serves to press the materials against the die or the punch, and to remove surplus resin.

The desired shape is thus obtained with the fibers being impregnated with the resin as well as possible.

That "lamination" technique, and in particular the "laying up" operation, is characterized by a very low level of automation, and a large labor input.

Although, by means of the concept of localizing the strength, that technique makes it possible to achieve performance levels that are high for the pieces that are made in that way, it requires rigorous monitoring of quality.

As a result, that technique is very costly and cannot be used at the high production throughputs implemented in many fields such as the automobile industry.

Generally, plastic pallets can be easily molded and are lighter in weight than wooden pallets. Furthermore, in general, plastic pallets are more durable than wooden pallets as shown in U.S. Pat. No. 5,497,709.

Plastics processing technology has enjoyed significant recent advances, such that traditional high-strength materials such as metals are being replaced with fiber composite materials. These materials are not only light, but also are flexible and durable.

U.S. Pat. Nos. 5,891,560 and 6,165,604 disclose fiber-reinforced composites prepared from a depolymerizable and repolymerizable polymer having the processing advantages of a thermoset without being brittle. Impregnation of polymer into the fiber bundle is achieved, while still producing a composite with desirable physical properties and high damage tolerance.

One factor that has limited the number of plastic pallets is that plastic pallets require a given amount of relatively expensive plastic material for a desired measure of pallet strength. U.S. Pat. Nos. 5,868,080 and 6,199,488 disclose reinforced plastic pallet constructions and assembly methods wherein multiple reinforcing bars are employed. The reinforcing bars preferably comprise composite structural members of fiberglass reinforced thermosetting plastic fabricated from a pultrusion process.

As noted in the above-mentioned '560 and '604 patents, although thermoset composites have excellent mechanical properties, they suffer from several disadvantages: thermoset matrices have relatively limited elongation, the thermoset precursors are a source of undesirable volatile organic compounds (VOCs), the composites cannot be reshaped or recycled, and their production rates are limited.

Consequently, in principle at least, thermoplastic composites would solve many of the problems associated with thermosets. For example, unlike thermosets, thermoplastics can be reshaped, welded, staked, or thermoformed. Furthermore, thermoplastics are generally tougher, more ductile, and have greater elongation than thermosets.

SUMMARY OF THE INVENTION

An object of the present invention is to provide a reinforced composite pallet assembly of the cellular core sandwich-type which can be made simply and cheaply, and can be implemented at high throughputs.

In carrying out the above object and other objects of the present invention, a reinforced composite pallet assembly of the sandwich type having a cellular core is disclosed. The assembly includes a substantially flat deck having front, back and side edges and includes: a) a load-bearing skin made of a reinforced thermoplastics material; b) an upper grid of reinforcing slats; c) a cellular core made of a thermoplastics material; d) a lower grid of reinforcing slats; and e) a tine-engaging skin made of a reinforced thermoplastics material. The upper and lower grids of reinforcing slats are positioned symmetrically with respect to a plane formed by the cellular core at predetermined places against the skins and the cellular core and the shape of the deck being obtained from a single pressing stage. At least one support supports the deck so that tines can lift and support the pallet at the tine-engaging skin.

Slats of each of the grids may be positioned adjacent to the front, back and side edges of the deck and may extend from positions adjacent the front, back and side edges of the deck to a center of the deck.

The deck may include at least one outer covering layer made of a woven or non-woven fabric disposed on the load-bearing skin and covering the front, back and side edges of the deck.

The assembly may further include another deck wherein the at least one support interconnects the decks at their tine-engaging skins and wherein the assembly is at least stackable or rackable.

The other deck may include an outer covering layer made of a woven or a non-woven fabric disposed on its load-bearing skin and covering its front, back and side edges.

The single pressing stage may have a forming pressure for forming the deck which lies in the range $10^6$ Pa to $3\times10^6$ Pa.

While the deck is being formed, the skins may have a forming temperature lying in the range approximately 160° C. to 200° C.

The skins may be made of a woven fabric or mat of glass fibers and of a thermoplastics material.

The reinforcing slats of the grids may be made of reinforced thermoplastic composite.

The composite may be fiber-reinforced and may include a depolymerizable and repolymerizable thermoplastic polymer resin.

The resin may be a thermoplastic polyurethane.

The thermoplastics material of the skins may be a polyolefin and is preferably polypropylene.

The cellular core of the deck may have an open-celled structure of the tubular or honeycomb cell type, constituted mainly of polyolefin and preferably polypropylene.

A plurality of spaced supports may support the deck adjacent corners of the deck.

The at least one support may be made of a thermoplastics material and wherein substantially the entire pallet assembly is recyclable.

The assembly may further include an electronic identification device to allow the assembly and its corresponding load to be identified.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

Figure 1:
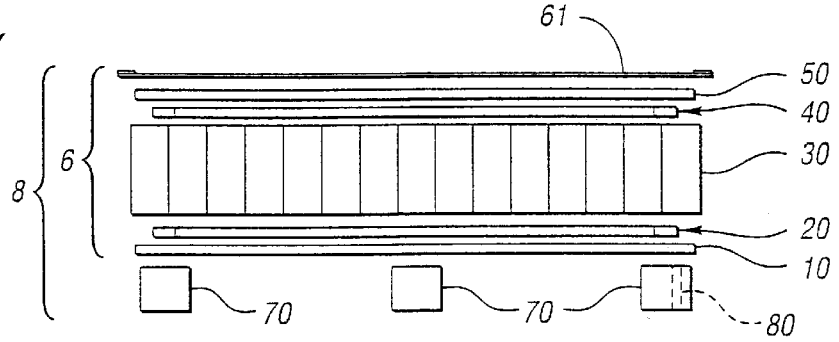
FIG. 1 is a side schematic view of a stack of layers of a deck and supports thereof wherein the layers and supports are shown vertically spaced from each other for clarity.
Figure 2:
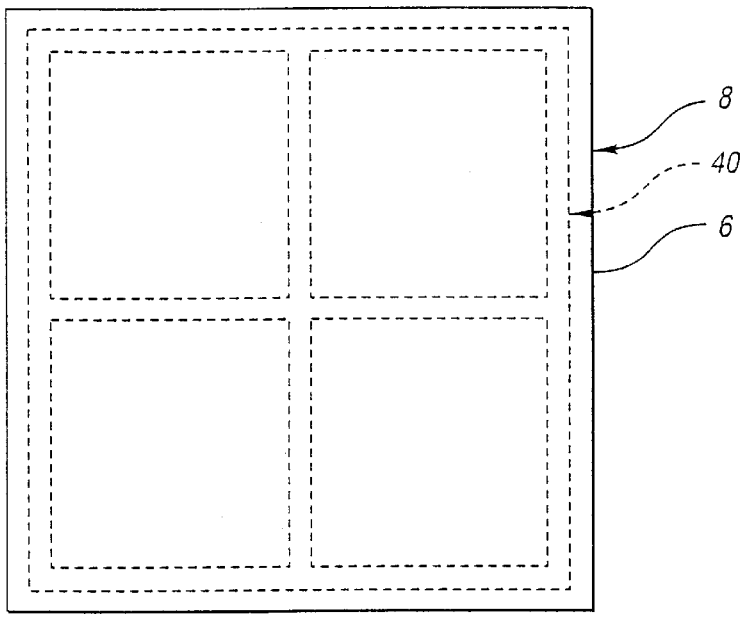
FIG. 2 is a top plan view of a pallet assembly of the present invention after the stack of layers of FIG. 1 are processed in a pressing stage with a grid of reinforcing slats illustrated by phantom lines.

FIG. 1 shows a stack formed during a first step of a method of making a reinforced composite pallet assembly of the cellular core sandwich-type of the present invention. The first step involves making a flat deck, indicated at 6 in FIG. 1. One of the flat decks 6 is used in a first embodiment of a pallet assembly (i.e. generally indicated at 8 in FIG. 2) and two of the decks are used in a second embodiment of the pallet assembly (i.e. indicated at 6 and 106 in FIG. 3).

In this example, the stack is made up successively of: a tine-engaging skin 10 made of a reinforced thermoplastics material; a lower grid of reinforcing slats 20 each of which may be made of a reinforced thermoplastic composite or pultrusion; a cellular core 30 made of thermoplastics material; an upper grid of reinforcing slats, generally indicated at 40, each of which may be made of a reinforced thermoplastic composite or pultrusion; and a load-bearing skin 50 made of a reinforced thermoplastic material. Alternatively, the slats may be made of other types of pultrusions or other materials such as metal.

In addition, the stack includes an outer covering layer 61 made of a woven or non-woven material disposed on the second skin 50. The outer covering layer 61 may be made of felt or of carpeting such as polypropylene carpeting.

Each of the first and second grids of reinforcing slats 20 and 40, respectively, has a surface area smaller than the surface area of each of the first and second skins 10 and 50, respectively. The first and second grids of reinforcing slats 20 and 40, respectively, are positioned symmetrically about the plane formed by the cellular core 30 at determined places against the skins 10 and 50, respectively. More particularly, the grids of slats 20 and 40 are positioned at those predetermined places of the pallet assembly 8 which are to be subjected to the greatest mechanical stresses caused by the load which is supported by the assembly 8.

The pallet assembly 8 also includes at least one support and, preferably, nine spaced apart, hollow thermoplastic supports or feet 70 for supporting the deck 6 so that tines of a fork lift vehicle can lift and support the pallet 8 at the inner surface of the tine-engaging skin 10.

An identification device 80 in the form of a microchip or an RF identification card may be positioned within one of the hollow feet 70 to allow the pallet 8 and its goods to be quickly and simply identified.

Each of the first and second skins 10 and 50, respectively, is advantageously constituted by a woven fabric or mat of glass fibers and of a thermoplastics material.

Each of the grids of reinforcing slats 20 and 40 is advantageously made of a reinforced thermoplastic composite of glass fibers and of a thermoplastics material such as a depolymerizable and repolymerizable thermoplastic polymer resin such as polyurethane. The slats may be solid or hollow elongated-profiles using pultrusion techniques as described in U.S. Pat. No. 5,891,560. Such technology is generally known as Fulcrum®, thermoplastic composite technology wherein Fulcrum® is a trademark of the Dow Chemical Co. of Midland, Mich.

Adding grids of reinforcing slats to the stack automatically leads to increased weight of the resulting deck 6 and, consequently, of the pallet assembly 8. In order to limit this increase in weight, it is important that the adding of the reinforcing slats to the grids be well controlled, and that only the bare minimum be added.

The additional weight of the reinforcing slats may be compensated by reducing the weight per unit area of glass fibers in the skins 10 and 50 used: by combining the weight per unit area of glass fibers in the skins 10 and 50 with the characteristics of the reinforcing slats, it is possible to obtain a deck of weight equivalent to the weight of a deck that does not use reinforcing slats, while offering strength that is more suited to its load requirement.

Thus, the skins 10 and 50 are typically of glass fiber weight per unit area that is different from that of the reinforcing slats 20 and 40.

Advantageously in this example, the cellular core 30 is an open-celled structure of the type made up of tubes or of a honeycomb, and it is made mainly of polyolefin and preferably of polypropylene.

In a second step of the method of making the pallet assembly 8, the stack of layers (but not the feet 20) is pre-assembled. Then, the pre-assembled stack is heated in an oven.

The pre-assembled stack is heated such that the skins 10 and 50 of the stack have a forming temperature approximately in the range of 160° C. to 200° C. The temperatures to which the pre-assembled stack is heated are higher than the degradation temperature of the polypropylene constituting the matrices of the skins 10 and 50, as well as the matrices of the reinforcing slats and of the cellular core 30, but that does not degrade the mechanical characteristics of the resulting deck 6.

The temperature to which the pre-assembled stack is heated in the method of making the deck 6 lies in a range extending from a low temperature enabling the skins 10 and 50 to be bonded to the cellular core 30, in a time compatible with mass production constraints, without the cellular core 30 of the stack being weakened accordingly, to a maximum temperature while avoiding degrading the polypropylene too rapidly.

In the method of making the deck 6, it is possible to add the reinforcing slats to the stack that is to be thermoformed to make the deck 6 because the method offers a heating capability that is sufficient to bond the skins 10 and 50 which are of different thicknesses (due to the added reinforcements).

The quantity of heat transmitted through the skins 10 and 50 and the cellular core 30 is inversely proportional to the thickness of the skins 10 and 50, for identical types of reinforcement.

For a given pre-assembled stack temperature and a given pre-assembled stack-heating time, it is possible to bond a skin of given thickness. If the skin is too thin, it reaches a temperature such that it is degraded. If the skin is too thick, the heat does not arrive in sufficient quantity to enable the skin and the core to be bonded together.

For example, in order to bond a skin made of a 4×1 woven fabric of weight per unit area of 915 g/m$^2$ to a cellular core, provision is made for the heating time to lie in the range 55 seconds to 75 seconds. By using an identical skin of weight per unit area of 1,420 g/m$^2$, a heating time lying in the range 70 seconds to 85 seconds is necessary to bond the skin to the cellular core without degrading it. Similarly, it has been determined that, for an identical skin having a weight per unit area of 710 g/m$^2$, a heating time lying in the range 55 seconds to 65 seconds is necessary to bond it to the cellular core without degrading it.

In a last step of the method of making the deck 6, after the pre-assembled stack has been heated in an oven, the deck 6 is formed by subjecting the heated stack to cold-pressing in a mold under a pressure lying in the range $1\times10^6$ Pa to $3\times10^6$ Pa.

The method of making the deck 6 comprises a small number of operations that are simple and quick to perform. It uses standard equipment (oven, press) for performing the above-mentioned operations which are controlled very well, and therefore entirely suitable for being implemented in the field of the pallet industry, in which the parts are formed at high production throughputs, while also guaranteeing constant quality and economic competitiveness.

The decks made by performing the method of the invention offer strength that is optimized locally, without suffering from any extra weight compared with decks not including any reinforcing slats, or from any extra manufacturing costs.

One of the advantageous applications of such decks whose structure is reinforced by reinforcing slats is to making pallet assemblies and, in particular, the pallet assemblies having attachment and support structures molded to the tine-engaging skin 10 of the deck 6. For example, the resulting deck 6 can be placed in a mold and the support structures 70 can be molded thereto. Also, attachment structures can be molded for securing bolts and the like thereto to secure loads on the deck 6 of the assembly 8. Alternatively, thermoplastic feet may be adhesively attached at the lower surface of the tine-engaging skin 10.

Figure 3:
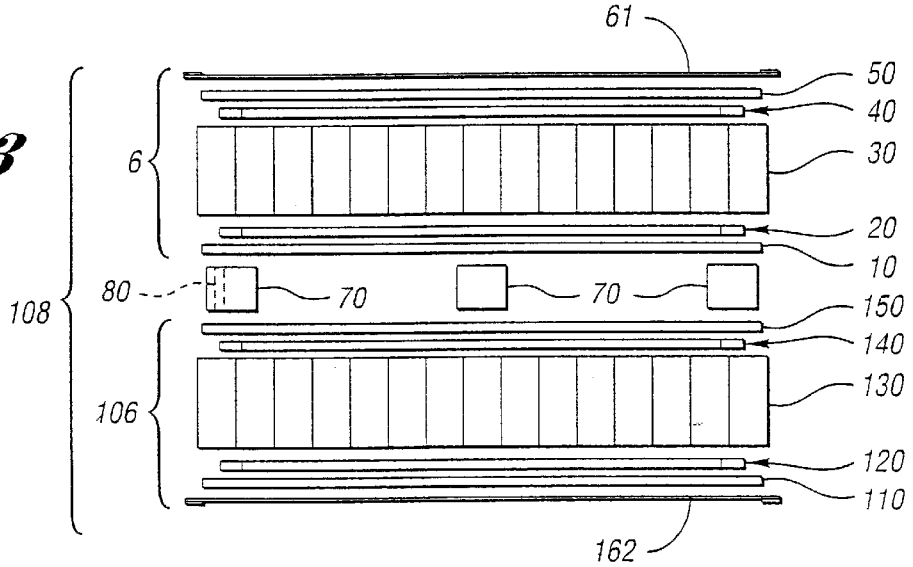
FIG. 3 is a view similar to FIG. 1 but showing a double-deck design for a stackable and rackable pallet assembly of the present invention.

Referring now to FIG. 3, there is shown a second pallet assembly 108 of the present invention. The assembly 108 includes a deck 6 as in the first embodiment, a second deck 106 substantially identical to the deck 6 and supports or spacers 70 for interconnecting the decks 6 and 106 to make the pallet assemblies 108 both stackable and rackable.

The deck 106, like the deck 6, includes a tine-engaging skin 150, an upper grid of reinforced slats 140, a cellular core 130, a lower grid of reinforced slats 120, a load-bearing skin 110 and an outer covering layer 162 made of a woven or non-woven material disposed on the load-bearing skin 110 and covering the edges of the deck 106.

The use of grids of reinforcement slats in accordance with the present invention makes it possible to reduce both the cost and weight of the pallet assemblies for equivalent mechanical characteristics.

While the best mode for carrying out the invention has been described in detail, those familiar with the art to which this invention relates will recognize various alternative designs and embodiments for practicing the invention as defined by the following claims.

What is claimed is:

1. A reinforced composite pallet assembly of the sandwich type having a cellular core, the assembly comprising:

a substantially flat deck having front, back and side edges and including:

a load-bearing skin made of a reinforced thermoplastics material;

an upper grid of reinforcing slats;

a cellular core made of a thermoplastics material;

a lower grid of reinforcing slats; and a tine-engaging skin made of a reinforced thermoplastics material; the upper and lower grids of reinforcing slats being positioned symmetrically with respect to a plane formed by the cellular core at predetermined places against the skins, wherein the upper grid is connected to the load-bearing skin, the cellular core is connected to the upper grid, the lower grid is connected to the cellular core, and the tine-engaging skin is connected to the lower grid, and the cellular core and the shape of the deck being obtained from a single pressing stage; and at least one support connected to the tine-engaging skin for supporting the deck so that tines can lift and support the pallet at the tine-engaging skin.

2. The assembly as claimed in claim 1 wherein slats of each of the grids are positioned adjacent to the front, back and side edges of the deck.

3. The assembly as claimed in claim 2 wherein slats of each of the grids extend from positions adjacent the front, back and side edges of the deck to a center of the deck.

4. The assembly as claimed in claim 1 wherein the deck includes at least one outer covering layer made of a woven or non-woven fabric disposed on the load-bearing skin and covering the front, back and side edges of the deck.

5. The assembly as claimed in claim 1 further comprising another deck as claimed in claim 1 wherein the at least one support interconnects the decks at their tine-engaging skins and wherein the assembly is at least stackable or rackable.

6. The assembly as claimed in claim 5 wherein the another deck includes an outer covering layer made of a woven or a non-woven fabric disposed on its load-bearing skin and covering its front, back and side edges.

7. The assembly as claimed in claim 1 wherein the single pressing stage has a forming pressure for forming the deck which lies in the range $10^6$ Pa to $3\times10^6$ Pa.

8. The assembly as claimed in claim 1 wherein while the deck is being formed, the skins have a forming temperature lying in the range approximately 160° C. to 200° C.

9. The assembly as claimed in claim 1 wherein the skins are made of a woven fabric or mat of glass fibers and of a thermoplastics material.

10. The assembly as claimed in claim 1 wherein the reinforcing slats of the grids are made of reinforced thermoplastic composite.

11. The assembly as claimed in claim 10 wherein the composite is fiber-reinforced.

12. The assembly as claimed in claim 11 wherein the composite includes a depolymerizable and repolymerizable thermoplastic polymer resin.

13. The assembly as claimed in claim 12 wherein the resin is a thermoplastic polyurethane.

14. The assembly as claimed in claim 9 wherein the thermoplastics material of the skins is a polyolefin and preferably polypropylene.

15. The assembly as claimed in claim 1 wherein the cellular core of the deck has an open-celled structure of the tubular or honeycomb cell type, constituted mainly of polyolefin and preferably polypropylene.

16. The assembly as claim in claim 1 wherein a plurality of spaced supports support the deck adjacent corners of the deck.

17. The assembly as claimed in claim 10 wherein the at least one support is made of a thermoplastics material and wherein substantially the entire pallet assembly is recyclable.

18. The assembly as claimed in claim 1 further comprising an electronic identification device to allow the assembly and its corresponding load to be identified.

* * * * *